US011827443B2

(12) United States Patent
Martin et al.

(10) Patent No.: US 11,827,443 B2
(45) Date of Patent: Nov. 28, 2023

(54) AEROSOL FOAM DISPENSER

(71) Applicant: The Procter & Gamble Company, Cincinnati, OH (US)

(72) Inventors: Matthew John Martin, California, KY (US); Matthew Corey Cataudella, West Chester, OH (US); Scott James Murschel, Terrace Park, OH (US); Nathanial David Thulin, Lebanon, OH (US); Laurie Michelle Taragano, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/735,389

(22) Filed: May 3, 2022

(65) Prior Publication Data

US 2022/0356003 A1 Nov. 10, 2022

Related U.S. Application Data

(60) Provisional application No. 63/183,586, filed on May 3, 2021.

(51) Int. Cl.
*B65D 83/54* (2006.01)
*B65D 83/20* (2006.01)
(Continued)

(52) U.S. Cl.
CPC ..... *B65D 83/54* (2013.01); *B65D 83/16* (2013.01); *B65D 83/20* (2013.01); *B65D 83/205* (2013.01);
(Continued)

(58) Field of Classification Search
CPC .. B65D 83/0038; B65D 83/16; B65D 83/205; B65D 83/384; B65D 83/386;
(Continued)

(56) References Cited

U.S. PATENT DOCUMENTS 153,759 A 8/1874 Blatt
160,098 A 2/1875 Hoyle et al.
(Continued)

FOREIGN PATENT DOCUMENTS

DE 102011088430 A1 8/2012
EP 1557160 A1 7/2005
(Continued)

OTHER PUBLICATIONS

"1,2 Octanediol (Caprylyl Glycol) & 1,2 Hexanediol"—an internet article obtained from the website:https://www.kumarorganic.net/Company/Blog-details.php?blogcode=KOP201901252CK1U5V5ZB, 5 pages. (date unknown).
(Continued)

*Primary Examiner* — Frederick C Nicolas
*Assistant Examiner* — Randall A Gruby
(74) *Attorney, Agent, or Firm* — Jay A. Krebs

(57) ABSTRACT

An aerosol foam dispenser for dispensing a foam antiperspirant or deodorant composition. The foam dispenser can have a pressurized container adapted for one or more propellants and a liquid deodorant or antiperspirant composition; a valve assembly, which can be a metered valve assembly, having a valve stem; an actuating mechanism in operative communication with the valve assembly, a dome with a skin contacting surface and one or more exit orifices in fluid communication with the valve stem; and a dip tube.

10 Claims, 7 Drawing Sheets

(51) Int. Cl.
*B65D 83/38* (2006.01)
*B65D 83/16* (2006.01)

(52) U.S. Cl.
CPC ..... *B65D 83/38* (2013.01); *B65D 83/384* (2013.01); *B65D 83/386* (2013.01)

(58) Field of Classification Search
CPC ..... B65D 83/20; B65D 83/38; B65D 83/54; B65D 83/32; B65D 83/7535; B65D 83/752
See application file for complete search history.

(56) References Cited

U.S. PATENT DOCUMENTS

| | | | | |
|---|---|---|---|---|
| D139,381 | S | 11/1944 | Harris | |
| D208,735 | S | 9/1967 | Rahn et al. | |
| D231,087 | S | 4/1974 | Edwards | |
| D240,112 | S | 6/1976 | O'Neil et al. | |
| D240,711 | S | 7/1976 | Angleman et al. | |
| 4,019,657 | A | 4/1977 | Spitzer et al. | |
| 4,174,386 | A | 11/1979 | Marra et al. | |
| D281,228 | S | 11/1985 | Grip et al. | |
| 4,991,751 | A | 2/1991 | Naku | |
| D315,292 | S | 3/1991 | Seager | |
| 5,226,563 | A * | 7/1993 | Coggiola | B65D 83/386 222/386 |
| D351,337 | S | 10/1994 | Bonnema et al. | |
| 5,618,515 | A | 4/1997 | Singh et al. | |
| D388,320 | S | 12/1997 | Lamb | |
| D395,597 | S | 6/1998 | Lamb | |
| 5,813,785 | A | 9/1998 | Baudin et al. | |
| 5,899,623 | A | 5/1999 | De | |
| 6,032,836 | A | 3/2000 | Hiscocks et al. | |
| D422,902 | S | 4/2000 | Kikuchi | |
| D437,548 | S | 2/2001 | Desgrippes et al. | |
| D445,337 | S | 7/2001 | Croft et al. | |
| D447,057 | S | 8/2001 | Bezek et al. | |
| D447,693 | S | 9/2001 | Warner et al. | |
| D448,281 | S | 9/2001 | Thibiant et al. | |
| D452,823 | S | 1/2002 | Bezek et al. | |
| D501,133 | S | 1/2005 | Schuller et al. | |
| D535,563 | S | 1/2007 | Martin | |
| D536,220 | S | 2/2007 | Sandberg | |
| D538,178 | S | 3/2007 | Desgrippes et al. | |
| D554,505 | S | 11/2007 | Gilbert | |
| D569,253 | S | 5/2008 | Cracchiolo | |
| D582,278 | S | 12/2008 | Bourne | |
| D616,261 | S | 5/2010 | Lundstroem | |
| D616,262 | S | 5/2010 | Lundstroem | |
| D627,603 | S | 11/2010 | Eyal | |
| 7,905,673 | B2 * | 3/2011 | Swaile | B65D 83/30 222/402.1 |
| D639,166 | S | 6/2011 | Carreno | |
| D639,660 | S | 6/2011 | Carreno | |
| D639,662 | S | 6/2011 | Riguzzi | |
| D640,136 | S | 6/2011 | Liba | |
| D642,852 | S | 8/2011 | Sheppard et al. | |
| D647,802 | S | 11/2011 | Bunce et al. | |
| D653,112 | S | 1/2012 | White et al. | |
| 8,119,109 | B2 | 2/2012 | Tamarkin et al. | |
| D666,912 | S | 9/2012 | Kawai | |
| D671,836 | S | 12/2012 | Demarco | |
| D687,711 | S | 8/2013 | Demarco | |
| D700,060 | S | 2/2014 | Trevisan | |
| D714,162 | S | 9/2014 | Kang | |
| D717,654 | S | 11/2014 | Aular | |
| D746,691 | S | 1/2016 | Uchida | |
| 9,296,550 | B2 | 3/2016 | Smith | |
| D758,204 | S | 6/2016 | Hwang | |
| D759,501 | S | 6/2016 | Hwang | |
| D786,079 | S | 5/2017 | Ibáñez et al. | |
| D820,110 | S | 6/2018 | Burrowes et al. | |
| D858,198 | S | 9/2019 | Hsu | |
| 10,526,133 | B2 | 1/2020 | Zeik et al. | |
| D922,200 | S | 6/2021 | Dietvorst et al. | |
| D934,689 | S | 11/2021 | Berg et al. | |
| D938,282 | S | 12/2021 | Scott | |
| D951,094 | S | 5/2022 | Valcke | |
| 2004/0197295 | A1 | 10/2004 | Riedel et al. | |
| 2005/0123494 | A1 | 6/2005 | Swaile et al. | |
| 2010/0217176 | A1 | 8/2010 | Carrara et al. | |
| 2012/0138699 | A1 | 6/2012 | Prischak | |
| 2014/0086848 | A1 | 3/2014 | Tamarkin et al. | |
| 2014/0323993 | A1 | 10/2014 | Wilcox et al. | |
| 2017/0247170 | A1 | 8/2017 | Bilton et al. | |
| 2020/0148459 | A1 | 5/2020 | Bartolucci et al. | |

FOREIGN PATENT DOCUMENTS

| | | | |
|---|---|---|---|
| EP | 3162356 | A1 | 5/2017 |
| GB | 90038700130001 | | 4/2014 |
| JP | 2010254312 | A * | 11/2010 |
| WO | 03053388 | A1 | 7/2003 |
| WO | 2005048966 | A1 | 6/2005 |
| WO | 2008038140 | A2 | 4/2008 |
| WO | 2012131320 | A2 | 10/2012 |
| WO | D217243002 | | 5/2022 |
| WO | D217243003 | | 5/2022 |

OTHER PUBLICATIONS

"DOWSI L TM5562 Carbinol Fluid"—a Technical Data Sheet obtained from the website: https://www.dow.com/en-us/pdp.dowsil-5562-carbinol-fluid.04019849z.html#tech-content, 3 pages (date unknown).

All Office Actions, U.S. Appl. No. 29/759,855, filed Nov. 25, 2020.

All Office Actions; U.S. Appl. No. 17/734,188, filed May 2, 2022.

All Office Actions; U.S. Appl. No. 17/734,193, filed May 2, 2022.

All Office Actions; U.S. Appl. No. 29/781,997, filed May 3, 2021.

Unpublished U.S. Appl. No. 17/734,188, filed May 2, 2022, to David Frederick Swaile et al.

Unpublished U.S. Appl. No. 17/734,193, filed May 2, 2022, to David Frederick Swaile et al.

PCT Search Report and Written Opinion for PCT/US2022/027361 dated Jul. 27, 2022, 14 pages.

Secret Weightless Dry Spray Antiperspirant for Women; Available online:https://www.amazon.com/Secret-Antiperspirant-Depdorant-Women-Spray/dp/B09NPS16JW/ref=sr_1_2; dated Aug. 8, 2022, 7 pages.

* cited by examiner

AEROSOL FOAM DISPENSER

FIELD OF THE INVENTION

The present invention is directed towards antiperspirant or deodorant products in combination with an aerosol foam dispenser, wherein the dispenser is designed to conveniently dispense a metered dose of the foam composition.

BACKGROUND OF THE INVENTION antiperspirant or deodorant products deliver materials to the underarm (axilla skin) that reduce eccrine gland sweating, control the growth of odor causing bacteria, and provide a fragrance benefit. These products are known in many forms, including roll-ons, gels, creams, sticks, sprays, and foams. Consumers choose their form based on personal requirements for application experience (rub on or spray), application feel (i.e., wet or dry), product performance for odor and wetness control, and the appearance of product residue on skin or clothing. In general, there is a desire from consumers to have a product that has a convenient application process, dries quickly on skin, creates little to no white residue on skin or clothes, provides all day odor and wetness control, and delivers a pleasant fragrance experience that lasts all day.

Within the set of known products, foams are less common but can provide the above desired benefits without some of the negatives of other forms. Aqueous foam products typically have a density of less than 0.2 grams/ml, which allow users to easily spread a lower product dose across the entire axilla. Often foam products are used at a dose of 0.1-0.3 grams per axilla, which is lower than the 0.3-0.6 gram dose of other rub on products like roll-ons, sticks and creams. The lower dose of the foam reduces the drying time, even versus gels, which also contain water. Another benefit of foams is that they typically do not contain a high level of structurant waxes like many sticks. Without the high level of structurant and applied at lower doses, the foams reduce the amount of visible residue that can be seen on skin or transferred to clothing. Sprays can deliver low doses that cover the axilla, but they often create a gassy cloud during application that is undesirable to many consumers. Foam products do not create this cloud during application.

One reason that foams have been less popular to date is that it can be difficult to cleanly and conveniently dispense a consumer acceptable foam that contains antiperspirant or deodorant actives.

For a foam antiperspirant or deodorant composition to be consumer acceptable, consumers want several things that can be impacted by the aerosol foam dispenser. First, consumers want a foam with a desirable appearance, in particular they may prefer a dense creamy foam with small bubble size, similar to a shaving foam, and a matte finish, making the product look less wet, which connotates a faster drying time.

Consumers also want the aerosol dispenser to work across a range of temperatures, as these products are often exposed to temperature variation. For example, many consumers store antiperspirant or deodorant compositions in a gym bag, which they leave in the car for hours prior to their workout. When the temperature changes, the viscosity of the antiperspirant or deodorant composition changes causing many commercially available aerosol foam dispensers to spurt when actuated and/or dispense foam that is low viscosity and/or has large bubbles, both of which can be messy and can result in inconsistent dosing that impacts product performance since the amount of active per volume of foam can vary with each use.

Therefore, there is a need for an aerosol foam dispenser that dispenses a metered dose of a dense creamy foam antiperspirant or deodorant product having a matte finish. Furthermore, the aerosol foam dispenser can dispense consistently across a range of temperatures without clogging or spurting.

SUMMARY OF THE INVENTION

An aerosol foam dispenser comprising: (a) a pressurized container having side walls, a closed base at a first end, and an open neck at a second end and defining a volume therein; wherein the volume is adapted for one or more propellants and a liquid composition; (b) a valve assembly for selectively dispensing product from said aerosol dispenser as a foam comprising: (i) a valve stem having a hollow center with a radial axis; wherein the hollow center is disposed for flow of the composition during dispensing and; (ii) a mounting cup joined to the neck; (b) an actuating mechanism in operative communication with the valve assembly; (c) a dome coupled to the valve stem; wherein the dome comprises an inner surface and a skin contacting surface having one or more exit orifices; wherein the one or more exit orifices and the radial axis of the valve stem are non-linear; (d) a diptube comprising an end open to the liquid composition and an end coupled to the valve assembly.

An aerosol foam dispenser comprising: (a) a pressurized container having side walls, a closed base at a first end, and an open neck at a second end and defining a volume therein; wherein the volume is adapted for one or more propellants and a liquid composition; (b) a metered valve assembly for selectively dispensing product from said aerosol dispenser as a foam comprising: (i) a valve stem having a hollow center disposed for flow of the composition during dispensing and an open end; (ii) a mounting cup joined to the neck; (c) an actuating mechanism in operative communication with the valve assembly; (d) a dome distal having a skin contacting surface; wherein the dome is coupled to the valve stem and the open end of the valve stem is approximately flush with the skin contacting surface; (e) a diptube comprising an end open to the liquid composition and an end coupled to the valve assembly.

An aerosol foam dispenser comprising: (a) a pressurized container having side walls, a closed base at a first end, and an open neck at a second end and defining a volume therein; wherein the volume is adapted for one or more propellants and a liquid composition; (b) a valve assembly for selectively dispensing product from said aerosol dispenser as a foam comprising: (i) a valve stem having a hollow center; (ii) a mounting cup joined to the neck; (c) an actuating mechanism in operative communication with the valve assembly; (d) a dome coupled to the valve stem; wherein the dome comprises an inner surface, a skin contacting surface having one or more exit orifices, and an umbrella valve in fluid communication with the one or more exit orifices; (e) a diptube comprising an end open to the liquid composition and an end coupled to the valve assembly.

DETAILED DESCRIPTION OF THE INVENTION

Figure 1:
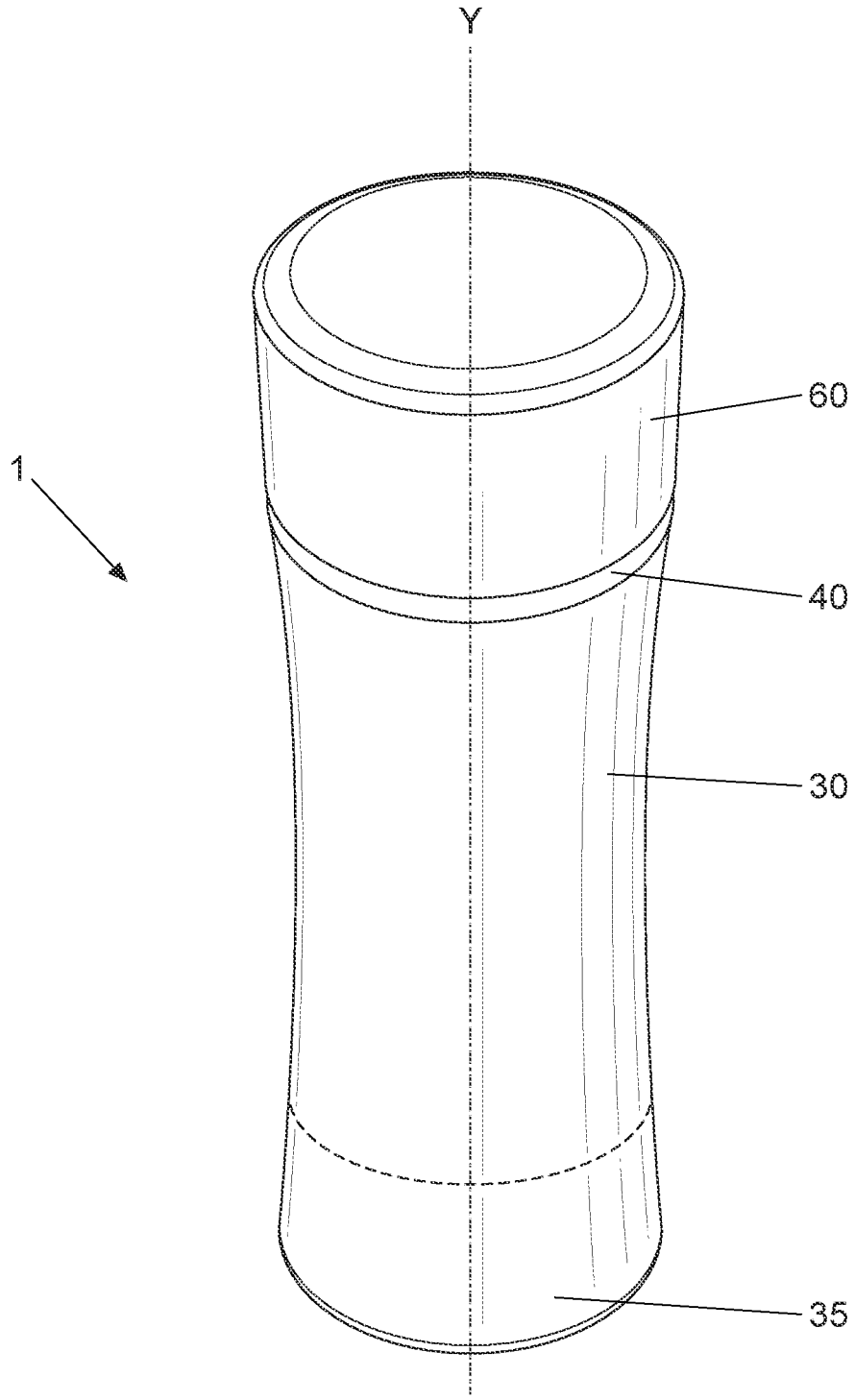
FIG. 1 is a perspective view of an aerosol foam dispenser.
Figure 2:
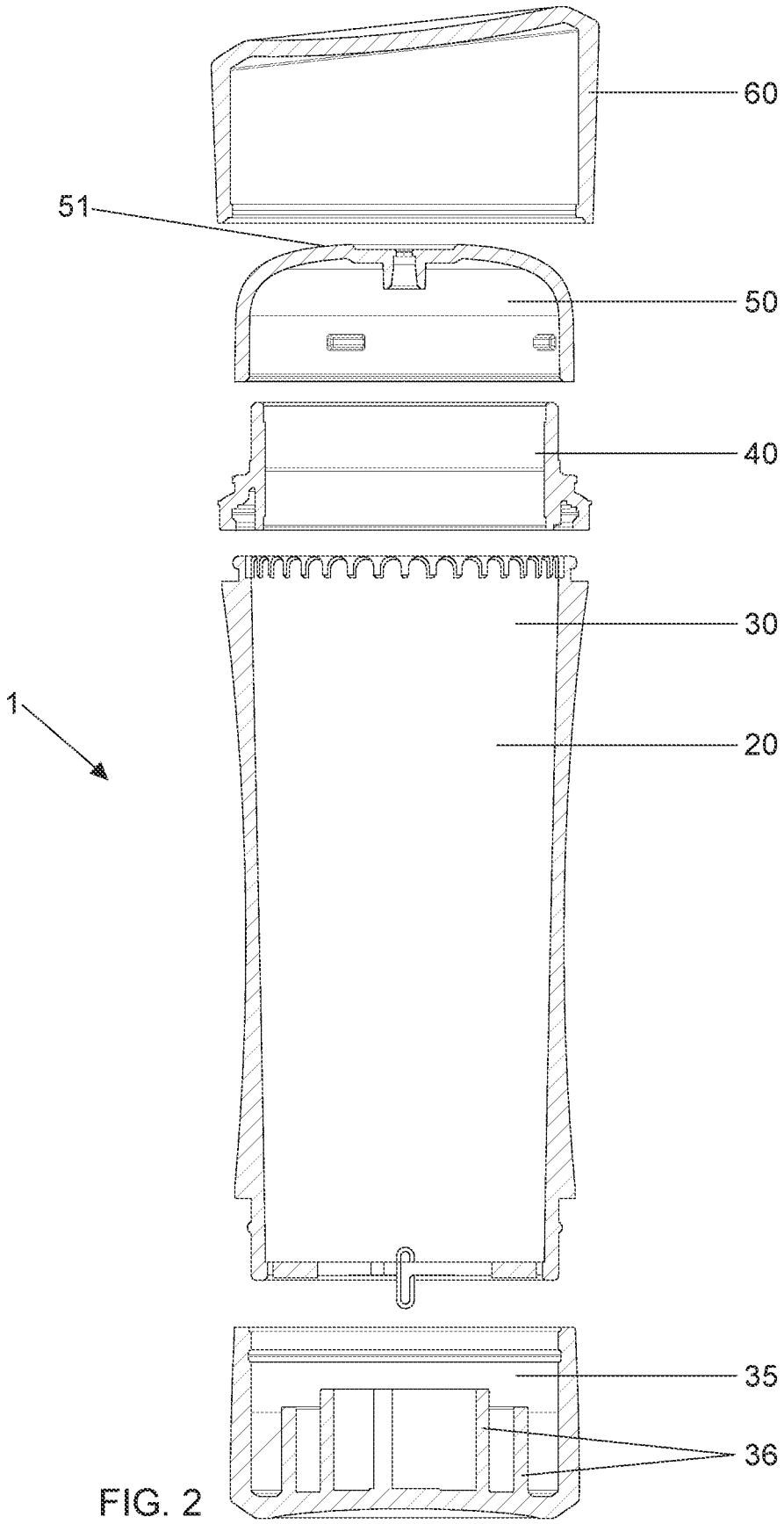
FIG. 2 is an exploded cross-sectional view along axis-Y of the aerosol dispenser of FIG. 1.

FIG. 1 shows aerosol dispenser 1, which is designed to store, dispense, and apply an antiperspirant or deodorant composition directly to the skin, particularly the underarm (axilla) of a user. FIG. 2 is an exploded cross-sectional view of some of the components of the dispenser of FIG. 1 along axis-Y, which is a longitudinal axis.

The aerosol dispenser 1 has a container 20 for storing, under pressure, the antiperspirant or deodorant composition. The pressurized container 20 can have a generally cylindrical configuration, and may comprise, in a horizontal cross-section: a circle, oval, rectangular, polygon, or any other suitable shape, symmetrical as well as asymmetrical. The pressurized container can be a metal can, or a glass or plastic container. The container can be recyclable, disposable, and/or reusable. The length of the container can be parallel to axis-Y. The container can have a pressure of at least 5 PSI greater than atmospheric pressure at 25° C. The container can be fitted with a valve to close the package and release the pressurized product when actuated by the user. It may be beneficial to utilize a metered valve that would allow a user to discharge a small predetermined amount of the foaming antiperspirant composition during a single act of discharge, thereby minimizing the possibility for the user to over-dispense or under-dispense the product. This may be desirable in that it ensures that the user dispenses the ideal volume of the composition for each use and substantially reduces the likelihood of a user over-dispensing the composition, which can result in the product becoming messy or have poor application feel, or under-dispensing the composition, which can result in less efficacy. In other examples, the valve can be a continuous valve.

Several types of materials can used to pressurize the container of the present invention. These materials include, but are not limited to, propellants that can include compressed gases. Propellants of the present invention include, but are not limited to, butane, isobutane, propane, dimethyl ether, 1,1difluoroethane and mixtures thereof. Compressed gases of the present invention include, but are not limited to, nitrogen ($N_2$), carbon dioxide ($CO_2$), and mixtures thereof. In some examples, the propellant can include both dimethyl ether and nitrogen ($N_2$).

The aerosol dispenser 1 can have a shroud 30 that can substantially surround the side walls 21 and at least a portion of, if not substantially the entire, base 23 of pressurized container 20.

Shroud 30 can be made of any suitable material including metal, glass, plastic, and combinations thereof. Shroud 30 can be recyclable, disposable, and/or it can be reusable. If the shroud is reusable or recyclable it can be easily separatable from the pressurized container without significant damage to the shroud and/or pressurized container. In one example, shroud 30 can be reusable and the consumer can purchase a new pressurized container and load it from the open top and/or the bottom of the shroud, so the container sits inside shroud 30. The refill process can be intuitive to consumers and they may not need detailed written instructions and/or the refill instructions can be explained in a few simple graphics with minimal words. After loading the container into the shroud, the user can press or snap dome 50 onto collar 40 that connects to shroud 30 and dome 50 and begin dispensing. Shroud 30 can include branding and other design elements for the product. Alternatively, shroud 30 can be transparent or translucent and the container can include the branding and other design elements. In some examples, the shroud and the container can both include branding and other design elements.

In one example, the shroud, dome, and cap are all made of plastic, for example these elements can all be made of plastic that is recyclable in the same recycling stream. The plastic pieces can contain polyethylene terephthalate, polypropylene, polyethylene, high-density polyethylene, low-density polyethylene, linear low-density polyethylene, and medium-density polyethylene, and combinations thereof. In one example, shroud 30 can have a contour shape with concave side walls, which can give aerosol dispenser 1 a sleek appearance and can also help provide good ergonomics for the aerosol hairspray product. In another example, the aerosol dispenser can be easily grasped with one hand.

The top end of the shroud is coupled by any suitable means, for example a snap fit or a press fit, to collar 40 which is coupled, by any suitable means, for example twist lock or bayonet fitment, a snap fit or a press fit, to dome 50. In another example, the shroud can be directly coupled to the dome. The base of the shroud, which is distal to the collar and dome, can coupled to actuating mechanism 35 by which a user can actuate the valve to dispense a desirable amount of the antiperspirant or deodorant composition in the form of foam. In one example, the actuating mechanism 35 can be a knob that a user can actuate by turning. Other examples of suitable actuation mechanisms can include a push button, a sliding (reciprocally moving) button, a rotating button, a spring-loaded device, a lever, etc. The shroud and actuating mechanism can be separate components or molded as a single component.

Figures 3A, 3B, 3C, 3D, 3E, 3F, 3G:
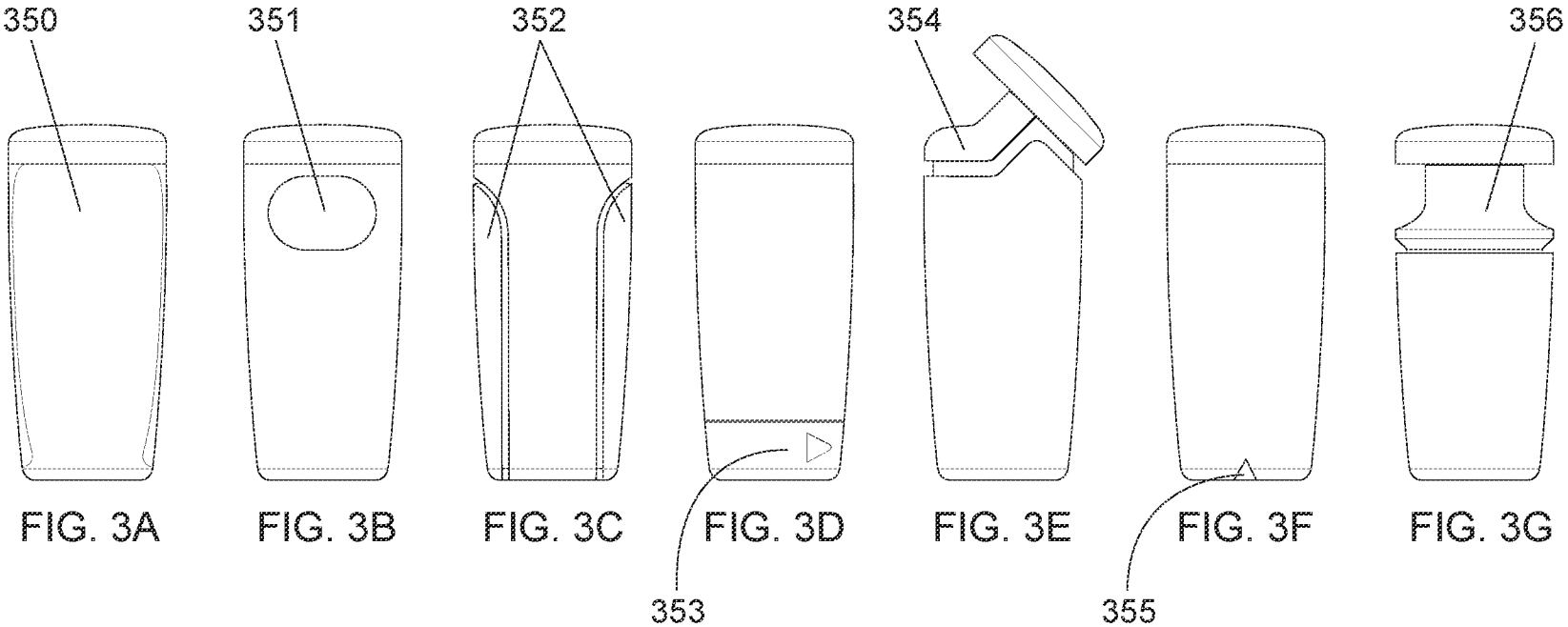
FIGS. 3A, 3B, 3C, 3D, 3E, 3F, and 3G show an aerosol foam dispenser with an actuating mechanism at different locations.

FIGS. 3A to 3G show foam dispensers with actuating mechanisms. In FIG. 3A, actuating mechanism 350 is actuated by pressing actuating mechanism 350, which is a large button that resides along approximately the entire length of the container. In FIG. 3B, actuating mechanism 351 is actuated by pressing actuating mechanism 351, which is a button, near the top of the container towards the dome. In FIG. 3C, the actuating mechanism 352 is actuated by pressing and/or squeezing actuating mechanisms 352 that are on both sides of the aerosol dispenser. In FIG. 3D, actuating mechanism 353 is actuated by pressing, turning, and/or pulling the actuating mechanism 353. In FIG. 3E, the actuating mechanism 354 is pressed or pulled to actuate it and the foam composition is dispensed at an angle, approximately 45-degree angle, from the lateral axis. In FIG. 3F, actuating mechanism 355 is actuated by pressing actuating mechanism 355, which is a small button at the base of the aerosol dispenser. In FIG. 3G, actuating mechanism 356 is actuated by pressing or pulling the top of the aerosol dispenser thereby moving actuating mechanism 356. In some examples, the actuating mechanism can be actuated by a user's thumb and/or first finger.

Dome 50 can include skin-contacting surface 51 that can be structured and configured to contact the desired skin area (typically an underarm area) of a user, thereby applying an effective amount of the foaming antiperspirant composition directly to the user's underarm area. By "direct" application, it is meant that a consumer need not use their hand to transfer the foaming antiperspirant or deodorant composition from the applicator to the underarm area, but instead should use the skin-contacting surface 51 to apply the desired amount of the foaming composition to the skin. This can provide the important benefit of avoiding the need to remove the composition from the consumer's hand and allows the user to avoid overdosing, as well as and under-dosing, the amount of the antiperspirant or deodorant composition. The skin-contacting surface 51 may have a variety of shapes, as long as those shapes are suitable for applying the antiperspirant foam to the underarm area of a consumer in a convenient manner while the foam is maintained on the skin-contacting surface as the consumer moves the aerosol foam dispenser to begin the application process without dripping or flowing down therefrom or otherwise causing messiness, even though the aerosol dispenser 1 can be substantially inclined during this movement by the user. For example, the skin-contacting surface 51 may be planar, concave, convex, concave-convex, irregular, or may comprise any combination thereof.

The skin-contacting surface 51 is the surface onto which the antiperspirant or deodorant composition is deposited during its discharge from the applicator. The antiperspirant composition is pressurized within the container 20 as a liquid but becomes a foam as it is discharged onto the skin-contacting surface 51. One skilled in the art would appreciate that foam is a dispersion of gas bubbles in a continuous liquid medium. In the foaming antiperspirant composition of the present invention the antiperspirant active is suspended or dissolved in such a continuous liquid medium.

Figure 4:
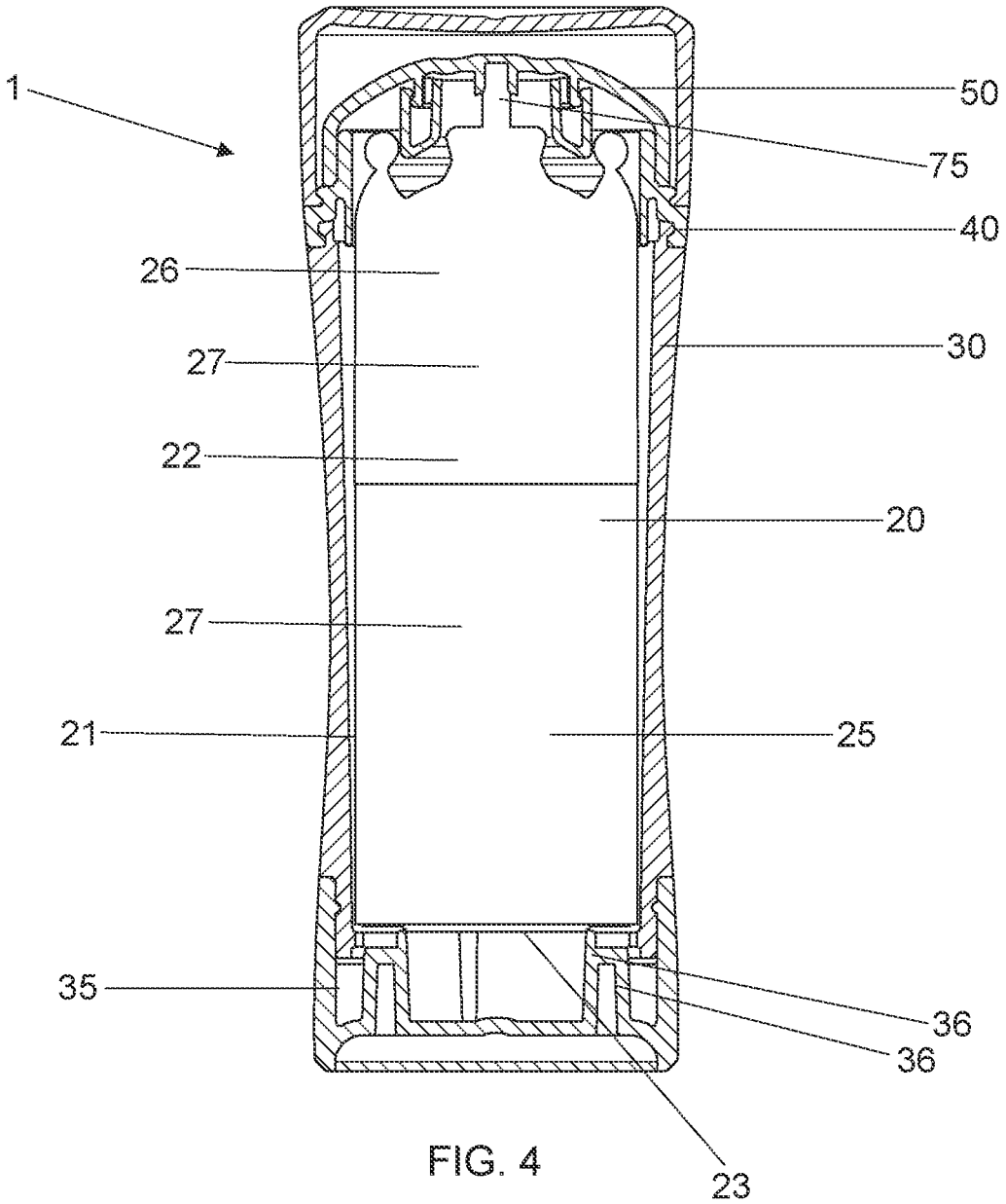
FIG. 4 is a cross-sectional view along axis-Y of the aerosol dispenser of FIG. 1 without the valve assembly and dip tube.
Figure 5A:
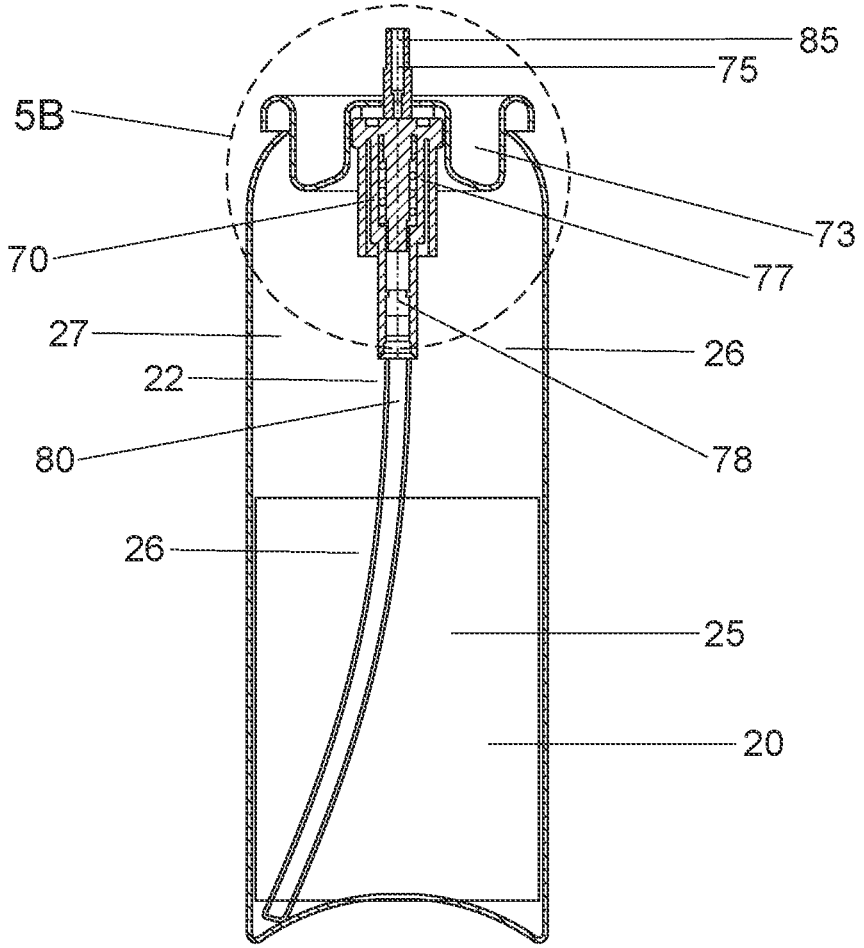
FIG. 5A is a cross-sectional view along axis-Y of the aerosol dispenser of FIG. 1, which includes the valve assembly and dip tube.

FIG. 4 is an assembled cross-sectional view along axis-Y of the aerosol dispenser in FIG. 1. A cross-sectional view of pressurized container 20 that includes dip tube 80 and metered dose valve assembly 70 is in FIG. 5A. The components shown in FIG. 5A are present but are omitted from FIG. 3 for clarity of the drawing. FIG. 4 shows pressurized container 20 that contains a liquid composition and a headspace 22. The liquid composition can include antiperspirant or deodorant composition 25 and optionally propellant 27. The headspace can contain one or more propellants, such as propellant 26 and optionally propellant 27. In the headspace, the propellant can be a gas. The propellant can be any suitable propellant including a compressed gas, such as nitrogen, or it can be a hydrocarbon propellant, such as dimethyl ether, or combinations thereof. When the propellant is a hydrocarbon propellant, it can be in the headspace and/or it can be a liquid that mixes with composition 25. In some examples, two propellants, in particular dimethyl ether and nitrogen gas, may be used to dispense a foam antiperspirant or deodorant composition with the desired density, bubble size, and gloss.

FIG. 5A shows dip tube 80, for example a capillary dip tube, extending into pressurized container 20 and has an upper portion which attaches to housing tailpiece 78 which is connected to metered dose valve assembly 70. Metered dose valve assembly 70 can be sealingly disposed to an open upper end of pressurized container 20 via mounting cup 73. Dip tube 80, housing tailpiece 78, metering chamber 76, and valve stem 75 are in fluid communication. Tailpiece 78 and valve housing 71 can be one piece or it can be multiple pieces. A mounting cup 73 can sit over the valve housing 71 and can be separated from the valve housing 71 by means of one or more gaskets 74 that are made from a resilient material. Mounting cup 73 can have a centrally located aperture 72, which the valve stem 75 extends through. Valve stem 75, valve assembly 70, tailpiece 78, and/or dip tube 80 can be fluidly connected. In some examples, metering chamber 76, dip tube 80, and/or the tailpiece 78 can be fluidly connected by the same open channel that runs through the center of these elements. Valve stem 75 is adapted for reciprocal vertical movement through aperture 72 and into a metering chamber 76 which is formed in the central hollow portion of valve housing 71.

Figure 5B:
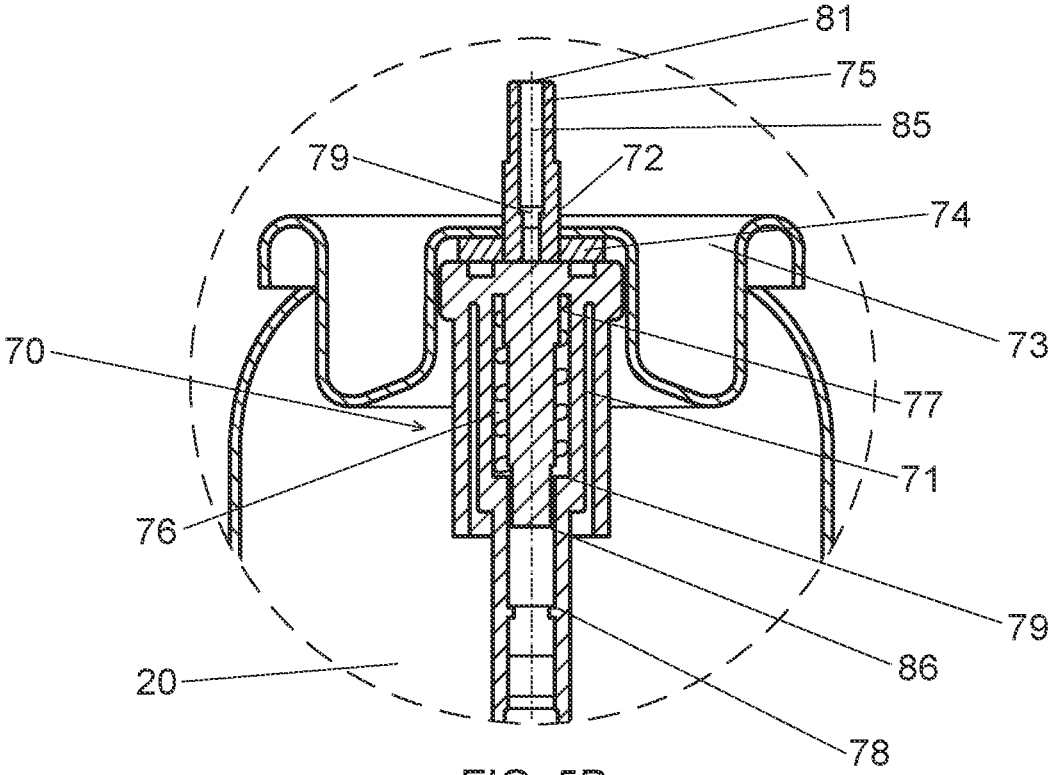
FIG. 5B is an enlarged view highlighting the valve assembly of FIG. 5A.

FIG. 5B is an enlarged cross-sectional view showing metered dose valve assembly 70 that can include valve stem 75, mounting cup 73, gasket 74, valve housing 71, spring 77, metering chamber 76, and tailpiece 78. The valve assembly 70 can be crimped in place at the open upper end of the container 20 with mounting cup 73, which can also be coupled or otherwise attached to dome 50, or collar 40. The valve assembly 70 in FIGS. 5A and 5B is in the closed/unactuated fill position.

Figure 6A:
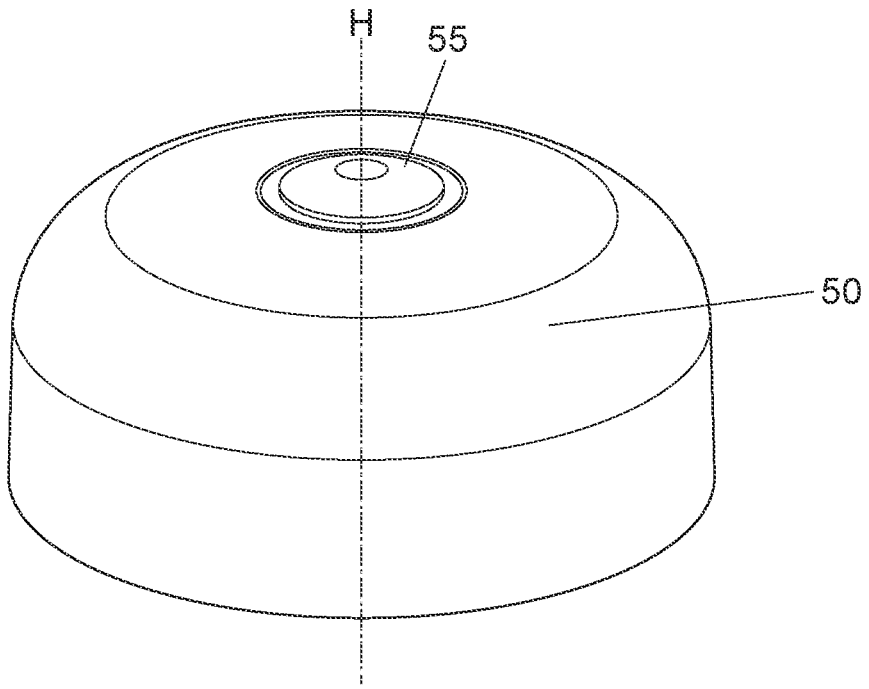
FIG. 6A is a perspective view of the dome.
Figure 6B:
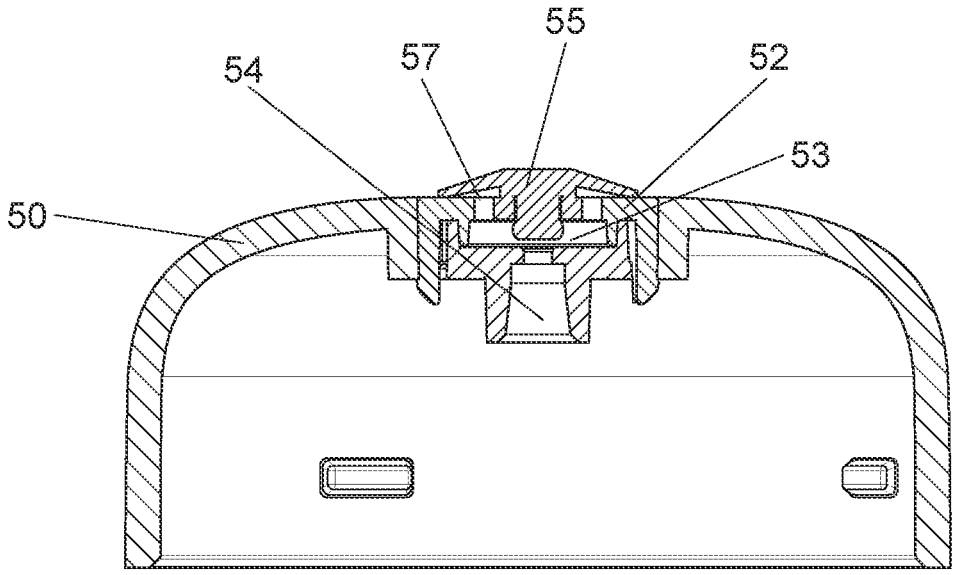
FIG. 6B is a cross-sectional view along line-H of the dome of FIG. 6A.

In the example in FIGS. 6A and 6B, dome 50 can include optionally include insert 52, one or more channels 53 with one or more exit orifices 57, and umbrella valve 55. Dome 50, insert 52, and umbrella valve 55 can be molded as one-piece, separate pieces, or combinations thereof.

In one example, dome 50 has an orifice that fits insert 52, in this example the dome and insert are separate pieces. In another example, insert 52 and dome 50 can be one piece. Insert 52 can include stem pocket 54 that is adapted to be coupled with the end and of the valve stem. Insert 52 can be adapted to hold umbrella valve 55, for example by press fit or by snap fit. In one example, the insert and umbrella valve can be one piece, for instance, the umbrella valve can be overmolded into the insert.

Dome 50 can include a means that prevents the composition from having a direct linear path from the opening at the end of the stem (shown in FIG. 5B at 81) to exit orifice 57. It was found that if the dispenser had a direct linear path from the opening at the end of the stem to the exit orifice, the dispenser easily spurted, auto-dispensed, and/or clogged, which frustrated the consumer. The dome can include a non-linear flow path through by any suitable means including a static mixer, a mesh screen or cross-hatching, or a specific valve, such as an umbrella valve. In the example shown in FIG. 6B, dome 50 includes one or more channels 53 that are fluidly connected to the stem. In one example, the one or more channels 53 can be formed in the space between insert 52 and umbrella valve 55. Alternatively, the one or more channel(s) can be formed into dome 50 and/or insert 52. In one example, each channel can be less than 2 cm in length, alternatively less than 1.5 cm, alternatively less than 1 cm, and alternatively less than 7 mm in length.

The one or more exit orifices 57 are non-linear to a radial axis through the valve stem. The one or more channels can have at least a portion that is not parallel to the longitudinal or radial axis. The channels can have at least a portion that has an angle from about 10° to about 170° from the longitudinal axis, alternatively from about 20° to about 160° from the longitudinal axis, alternatively from about 30° to about 150° from the longitudinal axis, alternatively from about 40° to about 140° from the longitudinal axis, alternatively from about 50° to about 130° from the longitudinal axis, alternatively from about 60° to about 120° from the longitudinal axis, alternatively from about 70° to about 110° from the longitudinal axis, alternatively from about 80° to about 100° from the longitudinal axis, and alternatively from about 85° to about 95° from the longitudinal axis. In some examples, the channels can have a portion that is approximately perpendicular to the longitudinal axis.

As shown in FIG. 6B, insert 52 can be adapted to engage umbrella valve 55. Umbrella valves can be an elastomeric valve component that can have a diaphragm shaped sealing disk. When mounted in an insert, dome, or molded or overmolded directly into the dome, the convex diaphragm can flatten and create a certain sealing force. The umbrella valve will allow forward flow once the head pressure caused by dispensing the foam through the stem and channels, creates enough force to lift the convex diaphragm from the seat and so it will allow flow at a predetermined pressure in one way and prevent back flow immediately in the opposite way.

In another example, the dome can have an orifice and the valve stem can extend into the orifice and the end of the valve stem can be approximately flush with the skin contacting surface. This configuration can be sufficient to prevent clogging.

As shown in FIGS. 4, 5A, and 5B, actuating mechanism 35 is in operative communication with metered dose valve assembly 70. The purpose of the metered dose valve assembly 70 is to ensure that only a small, predetermined amount of the deodorant and antiperspirant composition 25 is dispensed from the container each time the actuator is actuated. When actuating mechanism 35 is actuated (e.g., if the actuating mechanism is a knob, the knob is turned), the pressurized container 20 is elevated along the ramps 36 that extend from the inner surfaces (e.g., bottom and/or side walls) of the knob. The ramps can be any shape, size, steepness, or number to elevate the can for dispensing. In the example in FIG. 4, there are two ramps 36 that form concentric circles along the inside surface of the bottom of the knob where the inner ramp is taller than the outer ramp. After the container is raised to the second ramp there can be a flat plateau section to hold the valve open to allow dispensing a full dose.

A spring 77 extends from the underside of valve stem 75 to the bottom inside portion of metering chamber 76. As the container is elevated along the ramps, valve stem 75 is pushed against an inside surface of dome 50, depressing spring 77, which drops valve stem orifice 79 below gasket 74, allowing the composition 25 and optionally the first propellant 26, if present and liquified, to flow from the metering chamber 76 through the valve stem orifice 79 into the hollow valve stem center 85 and then through channel(s) 53 and around umbrella valve 55 as a foam antiperspirant or deodorant composition, which are shown in FIGS. 6A and 6B. In one example, when spring 77 is depressed, the base of valve stem 86 seals against one or more sealing rings 79 disposed at the bottom of metering chamber 76, preventing composition 25 from entering metering chamber 76 via the dip tube and being dispensed. The sealing rings can be made from a resilient material. In another example, when the spring is depressed, the bottom of the valve stem (the tail) can seal preventing flow from the container. The antiperspirant or deodorant composition 25 dispenses substantially parallel to axis-Y, in FIG. 1. In another example, the antiperspirant or deodorant composition can dispense at an angel from about 0° to about 90° from axis-Y, alternatively from about 0° to about 70° from axis-Y, alternatively from 0° to about 60° from axis-Y, alternatively from about 0° to about 50° from axis-Y, alternatively 0° to about 45° from axis-Y, and alternatively 0° to about 30° from axis-Y.

After the antiperspirant or deodorant product is dispensed around umbrella valve 55, it can have sufficient rheology to remain on skin contacting surface 51 until the user applies it to their underarm.

After actuation, spring 77 releases, which can help lower the pressurized container 20 and raise the valve stem 75 to the closed position where valve stem orifice 79 is above the one or more gaskets 74, disengaging the base of valve stem 86 from sealing ring 79, and allowing the composition 25 and optionally the first propellant 26, into the metering chamber 76.

In some examples, the valve assembly can be a continuous valve, and the composition would be dispensed as a foam when the valve stem is depressed.

Antiperspirant Composition

Although any foaming antiperspirant composition may be used in the present invention, it is appreciated that the product will comprise an antiperspirant active suitable for application to human skin, a carrier liquid for the active, a foam-stabilizing agent, and a propellant. The concentration of antiperspirant active in the composition can be sufficient to provide the finished antiperspirant composition with the desired perspiration wetness and odor control. The antiperspirant active and the foam-stabilizing agent are dissolved or dispersed in the foam's continuous liquid medium. The product may also optionally contain cosmetic emollients, deodorant agents, fragrances, and skin health agents. Compositions that may be stored and dispensed by the aerosol foam dispensers described herein can be found in U.S. Prov. App. 63/183,142 and 63/183,144, incorporated by reference.

The term "antiperspirant composition" refers to any composition containing an antiperspirant active and which is intended to be applied onto skin. The term "deodorant composition" refers to any composition containing a deodorant active and which is intended to be applied onto skin.

In all embodiments of the present invention, all percentages are by weight of the antiperspirant or deodorant composition (or formulation), unless specifically stated otherwise. All ratios are weight ratios, unless specifically stated otherwise. All ranges are inclusive and combinable. The number of significant digits conveys neither a limitation on the indicated amounts nor on the accuracy of the measurements. All numerical amounts are understood to be modified by the word "about" unless otherwise specifically indicated. Unless otherwise indicated, all measurements are understood to be made at approximately 25° C. and at ambient conditions, where "ambient conditions" means conditions under about 1 atmosphere of pressure and at about 50% relative humidity. The term "molecular weight" or "M.Wt." as used herein refers to the number average molecular weight unless otherwise stated.

The term "total fill" or "total fill of materials" refers to the total amount of materials added to or stored within a reservoir(s) of a container. For example, total fill includes the propellant and antiperspirant or deodorant composition stored within a device after completion of filling and prior to first use.

The term "viscosity" means dynamic viscosity (measured in centipoise, cPs, or Pascal-second, Pa·s) or kinematic viscosity (measured in centistokes, cst, or $m^2/s$) of a liquid at approximately 25° C. and ambient conditions. Dynamic viscosity may be measured using a rotational viscometer, such as a Brookfield Dial Reading Viscometer Model 1-2 RVT available from Brookfield Engineering Laboratories (USA) or other substitutable model known in the art. Typical Brookfield spindles which may be used include, without limitation, RV-7 at a spindle speed of 20 rpm, recognizing that the exact spindle may be selected as needed by one skilled in the art. Kinematic viscosity may be determined by dividing dynamic viscosity by the density of the liquid (at 25° C. and ambient conditions), as known in the art.

Oil in Water Emulsion

The antiperspirant or deodorant foam compositions of the present invention may comprise an oil in water emulsion. An oil phase in these emulsions may comprise an emollient, an emulsifier and optionally other ingredients such as, but not limited to, co-emulsifiers, fragrances, deodorant actives, skin conditioners, or other oil soluble ingredients. Emollients in the present invention are water insoluble liquids that smooth, soften, or lubricate the skin and will typically comprise more than 30% of an oil phase. The role of the oil phase in the foam composition is multifold. An oil phase can be water insoluble enough to provide a stable emulsion, not interfere with the antiperspirant active, provide a solvent system for the fragrance, and provide a lubricious soft feel to the consumer's skin throughout the day. Moreover, it may not interfere with the formation of a stable foam that can be easily rubbed on the skin. The complexity of this role may be best accomplished with more than one oil phase, wherein the different oil phases remain segregated during the life of the product. Said differently, having multiple disparate phases allows each phase to be focused on specific goals, wherein the combination of phases provides all the desired benefits. Moreover, creating and stabilizing more than one oil phase can be best accomplished by creating oil phases with limited to no solubility in each other. The limited solubility allows the different oil phases to remain segregated both during the formation of the multiple emulsions (often done at elevated temperatures (i.e., 40° C.-60° C.)) and through extended storage of the products (i.e., more than 1 year). Furthermore, the inventors have found that having less than or at most about 5% solubility of the emollients of the second oil phase into the emollients of the first oil phase is sufficient to provide the desired stability, with less than or at most about 1% solubility being preferred, and less than or at most about 0.5% being more preferred. Specifically, the emollient(s) of the second oil phase may have less than or at most about 5% solubility in the emollient(s) of the first oil phase; in some embodiments the emollient(s) of the second oil phase may have less than or at most about 1% solubility in the emollient(s) of the first oil phase; and in some embodiments, the emollient(s) of the second oil phase may have less than or at most about 0.5% solubility in the emollient(s) of the first oil phase. The test method for determining oil phase emollient solubility is detailed in the Test Method section herein. While the first and second oil phases may comprise more than just emollients, having the emollient(s) of the second oil phase have less than or at most about 5% solubility in the emollient(s) of the first oil phase assures that the first and second oil phases remain separate, as the emollients drive the solubility of the oil phases.

First Oil Phase Emollients

The first oil phase may comprise an emollient or mixture of emollients that typically are a solvent for the fragrance in the composition. If the fragrance is not well solubilized by the emollient in the oil phase, it can become associated with the polar portion of the emulsifier, thereby reducing both emulsion stability and foam quality. In order to incorporate fragrance into the first oil phase without reducing the foam quality, certain emollients may be used that are good fragrance solubilizers. Water insoluble emollients that are good fragrance solvents often have moderate polarity that can be characterized by having a Hildebrand solubility parameter from about 14 to about 22 $(MPa)^{0.5}$. Often values lower than that can be soluble in the dimethicone emollient in the second oil phase, while values higher than that can be too polar or water soluble to create a stable oil in water emulsion. A description of solubility parameters and means for determining them are described by C. D. Vaughan, "Solubility Effects in Product, Package, Penetration and Preservation" 103 Cosmetics and Toiletries 47-69, October 1988; and C. D. Vaughan, "Using Solubility Parameters in Cosmetics Formulation", 36 J Soc. Cosmetic Chemists 319-333, September/October, 198, which descriptions are incorporated herein by reference. Additionally, it may be desirable for emollients in the first oil phase to have a molecular weight greater than about 500 daltons to reduce skin penetration of the fragrance, thereby maintaining the ability of the fragrance to volatilize and provide the desired long-lasting and pleasant fragrance experience.

In some cases, the high molecular weight emollients of the first oil phase may have a molecular weight of at least about 500 Daltons, or at least about 750 Daltons, in some other cases, at least about 1000 Daltons, and in some other cases, at least about 1500 Daltons. The emollients used may be liquid. Suitable moderate polarity high molecular weight or liquid emollients may include, but are not limited to, propoxylated fatty alcohols, propoxylated fatty acids, ethoxylated propoxylated fatty alcohols, ethoxylate propoxylated fatty acids, and combinations thereof. Suitable high molecular weight or liquid emollients may include propoxylated fatty acids and propoxylated fatty alcohols, such as PPG-15 stearyl ether, PPG-11 Stearyl ether, PPG-15 Lauryl ether, PPG-11 Lauryl ether, PPG-15 myristyl ether, PPG-11 myristyl ether, PPG-14 butyl ether, PPG-30 butyl ether, and PPG-30 Cetyl ether. As used herein, fatty alcohol or fatty acid chains of the high molecular weight emollients include linear or branched alkyl chains with more than 4 carbon atoms. Typical chain lengths are from 4 to 28 atoms, with some embodiments having chain lengths of 4 to 18 carbon atoms. Moreover in some embodiments, the emollient will have a viscosity of less than 500 cps, less than 200 cps, or less than 100 cps. This viscosity range can provide a light feel on skin which is desirable by some consumers.

The emollients in the first oil phase may comprise from about 5% to about 30%, by weight, of the antiperspirant or deodorant composition. In some embodiments, the antiperspirant or deodorant composition may comprise from about 10% to about 20%, by weight, of the antiperspirant or deodorant composition. Choice of the amount of the one or more emollients in the first oil phase is dependent on a variety of factors including, but not limited to, desired skin feel, foam appearance, and fragrance concentration. To provide adequate fragrance dissolution, the ratio of emollient in the first oil phase to fragrance in the first oil phase may be at least 1:1, or may range from about 1:1 to about 10:1, in some embodiments from about 1:1 to about 7:1, in other embodiments from about 1:1 to about 4:1, in other embodiments from about 3:1 to about 7:1, and in still other embodiments from about 1:1 to about 3:1. In some embodiments, the antiperspirant or deodorant composition may comprise from about 5% to about 30%, by weight of the composition, of first oil phase emollient(s) selected from or selected from the group consisting of propoxylated fatty alcohols, propoxylated fatty acids, ethoxylated propoxylated fatty alcohols, ethoxylated propoxylated fatty acids, or combinations thereof, that have a molecular weight of at least about 500 Daltons. In some embodiments, the antiperspirant or deodorant composition may comprise from about 5% to about 20%, by weight of the composition, or from about 10% to about 20%, by weight of the composition, of one or more first oil phase emollients having a molecular weight of at least about 750 Daltons, or of liquid emollients.

Second Oil Phase Emollients

The second oil phase comprises a silicone, specifically dimethicone, also referred to as polydimethylsiloxane, emollient that is not soluble in the first oil phase as shown by the emollient solubility test described herein. In some embodiments, the dimethicone can be blended with other dimethicone soluble emollients wherein the mixture is not soluble in the first oil phase as shown by the solubility test described herein. Dimethicone emollients provide a smooth feel throughout the day and reduce stickiness that can result from certain antiperspirant or deodorant actives. Dimethicone emollients generally have the following structure, where n is number of 2 or more:

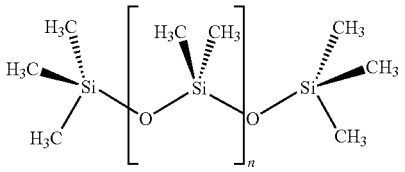

As n increases, the viscosity of the dimethicone emollient also increases. Moreover, as n increases, there is a general reduction in solubility in the organic emollients of the first oil phase. It then will be appreciated that a dimethicone emollient may be further characterized by, optionally, its viscosity, its molecular weight, its formula, or a combination thereof. In some instances, the polydimethylsiloxane fluid may have the following characteristics as shown in Table 1:

TABLE 1

| Viscosity | Approximate Molecular Weight[1] | Approximate Average Number of Monomer Units in the Polymer[1] |
|---|---|---|
| 3 Centistokes | 500 | 6 |
| 5 Centistokes | 800 | 9 |
| 10 Centistokes | 1200 | 13 |
| 20 Centistokes | 2000 | 27 |
| 30 Centistokes | 2600 | 35 |
| 50 Centistokes | 3800 | 50 |
| 100 Centistokes | 6000 | 80 |
| 200 Centistokes | 9400 | 125 |
| 350 Centistokes | 13,700 | 185 |

[1]The compositions of Examples herein, to the extent they contained a dimethicone fluid, were formulated utilitizing a Dow Corning DC200 series fluid, which is believed to have had average molecule weights and average number of monomer subunits falling within the approximate values of above-described table.

One skilled in the art will know that dimethicones with higher molecular weights will generally have lower solubility in many organic emollients than those with lower molecular weights, so it is often possible to design a second oil phase that is insoluble in the first oil phase (less than or at most 5% solubility via the test method) by choosing a high molecular weight dimethicone or by creating a mixture of dimethicones that provides both the requisite solubility and desired feel on skin.

The second oil phase may also contain other dimethicone soluble emollients such as, but not limited to, cyclic volatile silicones, linear volatile silicones, isoparrafins, alkyl dimethicones, capryl methicone, dimethiconol and high molecular weight silicone gums.

The emollients in the second oil phase may comprise from about 5% to about 30%, by weight, of the antiperspirant or deodorant composition. In some embodiments, the emollients in the second oil phase may comprise from about 3% to about 10%, by weight, of the antiperspirant or deodorant composition.

Emulsifiers, Surfactants and Co-Emulsifiers

The multiple oil phases in the oil in water emulsion may also comprise one or more of the following: emulsifiers, surfactants, and co-emulsifiers. These materials may perform several functions in the foaming antiperspirant or deodorant composition including, but not limited to, stabilizing the oil in water emulsion, reducing the surface tension of the water phase to allow foam formation, solublization of the propellant, and stabilization of the foam on the applicator surface. Choice of these materials is dependent on the composition of the oil in water emulsion, particularly the compositions of the emollients that are in the first and second oil phases. Moreover, it is desirable to choose materials that can provide multiple benefits, such as emulsion stabilization and foam creation/stabilization. Furthermore, the choice of any emulsifier, surfactant, or co-emulsifer must not interfere with the performance of the antiperspirant or deodorant actives used in the antiperspirant or deodorant composition. For example, the use of some anionic surfactants can interfere with efficacy of cationic aluminum antiperspirant actives via the formation of insoluble ion pairs. Lastly, it is appreciated that different oil phase emollients will require different emulsifiers, surfactants, or co-emulsifiers to create a stable multiphase oil in water emulsion. Said differently, the different oil phases that are insoluble in one another may require different emulsifiers and co-emulsifiers to stabilize each emulsion phase in the oil in water emulsion. Often, it may be convienent to add the appropriate emulsifiers, surfactant, and or co-emulsifer with each oil phase emollient to assure that they are associated with the desired oil phase.

An emulisifer or surfactant used to stabilize an emulsion may be chosen based on the required HLB (hydrophilic lipophilic balance) of the oil phase emollients. The HLB of a surfactant is a measure of the ratio of the hydrophobic to the hydrophilic portion of the surfactant or emulsifier. Choice of the desired HLB for an emollient is dependent on the emollient or emollient blend polarity and structure. The use of the HLB system for emulsion formulation is discussed in the following references:

1. Griffin W C; Calculation of HLB Values of Non-Ionic Surfactants, *Journal of the Society of Cosmetic Chemists;* 1954. Vol. 5, pp 249-235
2. Vaughan, C. D. Rice, Dennis A.; Predicting O/W Emulsion Stability by the "Required HLB Equation"; *Journal of Dispersion Science and Technology;* 1990. Vol. 11 (1), pp 83-91.

Any known oil in water emulsifier, surfactant, or co-emulsifer can be used in the foaming antiperspirant or deodorant compositions herein, provided that they stabilize the multiple emulsions and do not interfere with the delivery or action of the antiperspirant or deodorant actives. Suitable classes of emulsifiers and surfactants include anionic, cationic and nonionic materials. Moreover, for some oil phase emollients, polymeric emulsifiers and surfactants are suitable. In some embodiments, nononic emulsifiers, surfactants, and co-emulsifiers are preferred to prevent interaction with any charged antiperspirant active (i.e., aluminum chlorohydrate) or deodorant active (i.e., benzethonium chloride).

Emulsifer, surfactant, and coemulsifer concentrations will vary based on composition and level of each oil phase emulsion, however it is generally found to be desirable to not have excess emulsifier, surfactant and coemulsifer to prevent skin irritation. Total levels of emulsifier, surfactant, and coemulsifer should be less than about 12%, more preferably less than about 10% and most preferrably less than about about 7%, by weight of the composition.

Suitable nonionic emulsifiers and surfactants include, but are not limited to, linear saturated and unsaturated C12 to C30 primary alcohols that are etherified with 1 to 100 ethylene oxide units per molecule. More preferred nonionic emulsifiers laureth, trideceth, myristeth, ceteth, ceteareth steareth, arachideth, and beheneth, having respectively 1 to 100 ethylene oxide units per molecule. Some examples of preferred nonionic emulsifiers and surfacants include, but are not limited to, steareth-1, steareth-2, steareth-3, steareth-20, steareth-21, steareth-100, ceteareth-10. ceteareth-20 ceteareth-30, ceteth-1, ceteth-2, ceteth-3, ceteth-10, myristeth-1, myristeth-2, laureth-4, beheneth-2, beheneth-3, and beheneth-5, behenth-10 and beheneth-25.

In some embodiments of the present invention, steareth-2 and steareth-21 are preferred emulsifiers or surfactants. Preferred weight ratios of steareth-21 to steareth-2 range from about 0.2 to about 5, more preferably from about 0.2 to about 2. In some embodiments of the present invention Ceteth-10 and Laureth-4 are preferred emulsifiers or surfactants.

Suitable anionic emulsifiers and surfactants include, but are not limited to, ammonium lauryl sulfate, sodium laureth sulfate, sodium oleyl succinate, ammonium lauryl sulfosuccinate, sodium dodecylbenzenesulfonate, ammonium laureth, sodium N-lauryl sarcosinate, or sodium lauryl sulfate.

Suitable cationic emulsifiers and surfactants include, but are not limited to, distearyldimonium chloride, behentrimonium chloride and palmitamido-propyltrimonium chloride.

Suitable co-emulsifers include, but are not limited to, fatty alcohols such as stearyl alcohol, cetyl alcohol, and cetearyl alcohol. However, in some embodiments, the emulsion may not comprise a fatty alcohol, as fatty alcohols can increase the viscosity of the oil in water emulsion to a level that is difficult to mix with certain propellants, making them undesirable. One potential example of this would be if the fatty alcohol increased the viscosity about about 10,000 cst, which would be very difficult to mix with a water insoluble propellant, such as butane.

In some embodiments, ethoxylated fatty alcohols are preferred emulsifiers due to their ability to both stabilize the emulsion and create stable foams.

Fragrance

One or more fragrance materials are included to help cover or mask malodors resulting from perspiration or which otherwise provide the compositions with the desired perfume aroma. These fragrance materials may include any perfume or perfume chemical suitable for topical application to the skin.

The concentration of the fragrance in the foaming antiperspirant or deodorant compositions should be effective to provide the desired aroma characteristics or to mask malodor wherein the malodor is inherently associated with the composition itself or is associated with malodor development from human perspiration. Compositions of the present invention may comprise fragrances selected from the group consisting of free perfumes, encapsulated perfumes, and mixtures thereof. The total perfume may include one or more individual perfume chemicals provided that the perfume can emit a detectable perfume odor or can mask or help to mask odors associated with perspiration. Generally, the deodorant compositions of the present invention may comprise the total perfume at concentrations ranging from about 0.05% to about 10%, preferably from about 0.5 to about 5% and more preferably from about 1 to about 4%. As previously discussed the choice of fragrance level and the emollient level both in the first oil phase are often related by desired emollient to fragrance weight ratios of from about 1:1 to about 10:1, and more preferably, from 3:1 to about 7:1. The fragrance that is in the antiperspirant and/or deodorant composition may be entirely in the first oil phase and may be solubilized in the first oil phase.

Nonlimiting examples of fragrance materials suitable for use as a free perfume or an encapsulated perfume include any known fragrances in the art or any otherwise effective fragrance materials. Typical fragrances are described in Arctander, Perfume and Flavour Chemicals (Aroma Chemicals), Vol. I and II (1969) and Arctander, Perfume and Flavour Materials of Natural Origin (1960). U.S. Pat. No. 4,322,308, issued to Hooper et al., Mar. 30, 1982 and U.S. Pat. No. 4,304,679, issued to Hooper et al., Dec. 8, 1981 disclose suitable fragrance materials including, but not limited to, volatile phenolic substances (such as iso-amyl salicylate, benzyl salicylate, and thyme oil red), essence oils (such as geranium oil, patchouli oil, and petitgrain oil), citrus oils, extracts and resins (such as benzoin siam resinoid and opoponax resinoid), "synthetic" oils (such as Bergamot™ 37 and Bergamot™ 430, Geranium™ 76 and Pomeransol™ 314); aldehydes and ketones (such as B-methyl naphthyl ketone, p-t-butyl-A-methyl hydrocinnamic aldehyde and p-t-amyl cyclohexanone), polycyclic compounds (such as coumarin and beta-naphthyl methyl ether), esters (such as diethyl phthalate, phenylethyl phenylacetate, nonanolide 1:4).

Suitable fragrance materials may also include esters and essential oils derived from floral materials and fruits, citrus oils, absolutes, aldehydes, resinoides, musk and other animal notes (e.g., natural isolates of civet, castoreum and musk), balsamic, and alcohols (such as dimyrcetol, phenylethyl alcohol and tetrahydromuguol). For example, the present invention may comprise fragrances selected from the group consisting of decyl aldehyde, undecyl aldehyde, undecylenic aldehyde, lauric aldehyde, amyl cinnamic aldehyde, ethyl methyl phenyl glycidate, methyl nonyl acetaldehyde, myristic aldehyde, nonalactone, nonyl aldehyde, octyl aldehyde, undecalactone, hexyl cinnamic aldehyde, benzaldehyde, vanillin, heliotropine, camphor, para-hydroxy phenolbutanone, 6-acetyl 1,1,3,4,4,6 hexamethyl tetrahydronaphthalene, alpha-methyl ionone, gamma-methyl ionone, amylcyclohexanone, and mixtures thereof.

Antiperspirant or Deodorant Actives

The water phase of the water in oil emulsion generally includes water and an antiperspirant active and/or a deodorant active dissolved in water. The concentration of the antiperspirant active and/or deodorant actives in the composition should be sufficient to provide the finished antiperspirant or deodorant composition with the desired perspiration wetness and/or odor control benefits.

Exemplary antiperspirant active concentrations range include from about 0.1% to about 26%, from about 1% to about 20%, and from about 2% to about 10%, by weight of the composition. All such weight percentages are calculated on an anhydrous metal salt basis exclusive of water and any complexing or buffering agent such as, for example, glycine, glycine salts or other amino acids and any stabilizing agents such as calcium chloride, calcium salts, or strontium salts.

Preferred aluminum salts are those having the general formula $Al_2(OH)_{6-a}X_a$ wherein X is Cl, Br, I or $NO_3$, and a is about 0.3 to about 5, preferably about 0.8 to about 2.5. Preferred actives in this group include, but are not limited to, aluminum chlorohydrate (ACH) wherein a is from about 1 and the mole ratio of Al/Cl is from about 1.9 to about 2.1, Aluminum sesquichlorohydrate (ASCH) wherein a is from about 1.05 to about 1.61 and the mole ratio of Al/Cl is from about 1.26 to about 1.89, and aluminum dichlorohydrate (ADCH) wherein a is from about 1.6 to about 2.2 and the mole ratio of Al/Cl is from about 0.9 to about 1.25.

Preferred aluminum-zirconium salts are mixtures or complexes of the above-described aluminum salts with zirconium salts of the formula $ZrO(OH)_{2-pb}Y_b$ wherein Y is Cl, Br, I, $NO_3$, or $SO_4$, b is about 0.8 to 2, and p is the valence of Y. The zirconium salts also generally have some water of hydration associated with them, typically on the order of 1 to 7 moles per mole of salt. Preferably the zirconium salt is zirconyl hydroxychloride of the formula $ZrO(OH)_{2-b}Cl_b$ wherein b is about 0.5 to 2, preferably about 1.0 to about 1.9. The aluminum-zirconium salts employed in the present invention have an Al:Zr mole ratio of about 2 to about 10, and a metal:X+Y ratio of about 0.73 to about 2.1, preferably about 0.9 to 1.5. A preferred salt is aluminum-zirconium chlorohydrate (i.e. X and Y are Cl), which has an Al:Zr ratio of about 2 to about 10 and a metal:Cl ratio of about 0.9 to about 2.1. Thus, the term aluminum-zirconium chlorohydrate is intended to include the tri-, tetra-, penta- and octa-chlorohydrate forms. Aluminum-zirconium chlorohydrate is referred to as "ACH/ZHC" or as "AZCH" herein.

The aluminum and aluminum-zirconium salts of the present invention may be of the enhanced efficacy type. The term "enhanced efficacy salts" means antiperspirant salts which, when reconstituted as 10% aqueous solutions (or if already a solution, diluted with water to about 10% salt concentration in solution), produce an HPLC chromatogram (as described, for example, in U.S. Pat. No. 5,330,751, which is incorporated herein by reference) wherein at least 40%, preferably at least 50%, of the aluminum is contained in two successive peaks, conveniently labeled peaks 4 and 5, and wherein the ratio of the area under peak 4 to the area under peak 3 is at least 0.35, preferably at least 0.5, and more preferably at least 0.9 or higher. Most preferred are salts which exhibit an HPLC peak 4 to peak 3 area ratio of at least 0.35 when measured within two hours of preparation, and which retain a peak 4 to peak 3 area ratio of at least 0.35, preferably at least 0.7, when stored as an aqueous solution of at least 20% salt concentration for one month. Especially preferred are salts wherein at least 25%, more preferably at least 40%, of the aluminum is contained in peak 4. The aluminum present in peaks 3 and 4 should be of the $Al^c$ type, not $Al^b$, when analyzed by the ferron test. Enhanced efficacy aluminum chlorohydrate is referred to as "ACH" herein. Enhanced efficacy aluminum-zirconium chlorohydrate is referred to as "ACH'/ZHC" or as "AZCH'" herein.

The ACH and AZCH salts used in the present invention may also include soluble calcium salts. Soluble calcium salts are those calcium salts that are soluble in water or that dissolve in the aqueous solution of antiperspirant salt (i.e., a solution of the aluminum salt and/or zirconium salt). Calcium salts which may be utilized are any of those which do not otherwise interfere with the solubility or effectiveness of the antiperspirant salt. Preferred calcium salts include calcium chloride, calcium bromide, calcium nitrate, calcium citrate, calcium formate, calcium acetate, calcium gluconate, calcium ascorbate, calcium lactate, calcium glycinate and mixtures thereof. Calcium carbonate, calcium sulfate and calcium hydroxide may also be used because they will dissolve in an aqueous solution of the antiperspirant salt. The amount of calcium salt utilized in a AZCH salt should be that amount which provides a Ca:Al+Zr weight ratio of about 1:1 to about 1:28, preferably about 1:2 to about 1:25. Generally, the aqueous AZCH solution will contain about 0.3 to about 3% by weight Ca, preferably about 0.5 to about 2.5% by weight Ca, most preferably about 1.0 to about 2.0% by weight Ca, based on the weight of the entire composition. These amounts of calcium in the AZCH aqueous may be obtained by the inclusion of about 1% to about 7% by weight of calcium chloride, nitrate or sulfate or similar salts.

The ACH and AZCH salts used in the present invention may also contain a water soluble amino and/or hydroxy acid which is effective in increasing and/or stabilizing the HPLC peak 4:3 area ratio of the antiperspirant salt. Such acids include amino- and/or hydroxy-substituted lower alkanoic acids (including substituted derivatives thereof), preferably where the amino or hydroxy group is located on the α-carbon (i.e., the same carbon to which the carboxy group is attached). The lower alkanoic acid will generally have 2 to 6, preferably 2 to 4, carbon atoms in the alkanoic acid chain. Typical amino and/or hydroxy substituted lower alkanoic acids include any of the amino acids such as glycine, alanine, valine, leucine, isoleucine, P-alanine, serine, cysteine, β-amino-n-butyric acid, γ-amino-n-butyric acid, etc. and hydroxy acids such as glycolic acid and lactic acid. These amino and/or hydroxy substituted lower alkanoic acids may also contain various substituents which do not adversely affect their activity. The preferred amino and/or hydroxy substituted lower alkanoic acids are glycine, alanine, and glycolic acid, with glycine being most preferred. The amount of amino acid or hydroxy acid utilized in an AZCH salt should be that amount which provides an acid:Al+Zr ratio of about 2:1 to about 1:20, preferably about 1:1 to about 1:10, and most preferably about 1:2 to about 1:7. Generally, the aqueous AZCH salt solution will contain about 1% to about 15% by weight amino acid or hydroxy acid, preferably about 2% to about 10% by weight, based on the weight of the entire composition. The amino and/or hydroxy acid need not be separately added to the composition, but may be included as part of the antiperspirant salt complex such as, for example, Al—Zr-Gly salts (e.g., aluminum-zirconium tetrachlorohydrate-gly). The glycine content of such salts may be adjusted to provide the aformentioned ratio. The amino and/or hydroxy acid may also be added as a salt, particularly the calcium salt such as, for example, calcium glycinate.

In some embodiments, a preferred active is an aqeous solution of ADCH that also contains calcium chloride and glycine. The preferred ADCH with calcium chloride and glycine is further characterized by having more than 50% peak 4 and 5 as measured by HPLC, a Al:Cl molar ratio of about 0.9 to about 1.25, an Al to glycine wt ratio of about 1.7 to 7.7, and calcium to glycine wt ratio of about 0.1 to about 1.5. In some embodiments a preferred active is an aqeous solution of ASCH that also contains calcium chloride and glycine. The preferred ASCH with calcium chloride and glycine is further characterized by having more than 35% peak 4 and 5 as measured by HPLC, a Al:Cl molar ratio of about 1.26 to about 1.89, an Al to glycine wt ratio of about 4 to 10, and calcium to glycine ratio of about 0.1 to about 1.5.

The foaming antiperspirant or deodorant compositions provided herein may comprise a non-aluminum antiperspirant active. Suitable non aluminum antiperspirant actives include, but are not limited to, oxybutynin chloride, chitosan, PVM/MA polymers, calcium chanel blockers, gingerol, liquid fatty acid and metal ion combinations, magnesium gluconate, silicic acid, silicic acid salts, and vicinol diols such as propylene glycol.

The foaming antiperspirant and/or deodorant compositions provided herein may comprise a deodorant active, alternatively meaning that a deodorant active is substituted for an antiperspirant active or used in addition to the antiperspirant active. Some deodorants may not have an antiperspirant active and/or may be substantially free or free of aluminum.

Suitable deodorant actives may be selected from the group consisting of antimicrobial agents (e.g., bacteriocides, fungicides), malodor-absorbing material, and combinations thereof. For example, antimicrobial agents may comprise cetyl-trimethylammonium bromide, cetyl pyridinium chloride, benzethonium chloride, diisobutyl phenoxy ethoxy ethyl dimethyl benzyl ammonium chloride, sodium N-lauryl sarcosine, sodium N-palmethyl sarcosine, lauroyl sarcosine, N-myristoyl glycine, potassium N-lauryl sarcosine, trimethyl ammonium chloride, sodium aluminum chlorohydroxy lactate, triethyl citrate, tricetylmethyl ammonium chloride, 2,4,4'-trichloro-2'-hydroxy diphenyl ether (triclosan), 3,4,4'-trichlorocarbanilide (triclocarban), diaminoalkyl amides such as L-lysine hexadecyl amide, heavy metal salts of citrate, salicylate, and piroctose, especially zinc salts, and acids thereof, heavy metal salts of pyrithione, especially zinc pyrithione, zinc phenolsulfate, farnesol, and combinations thereof.

In some embodiments, antibacterials (deodorant actives) may be selected from the group consisting of 2-Pyridinol-N-oxide (piroctone olamine), lupamin, beryllium carbonate, magnesium carbonate, calcium carbonate, magnesium hydroxide, magnesium hydroxide and magnesium carbonate hydroxide, partially carbonated magnesium hydroxide, potassium carbonate, potassium bicarbonate, sodium carbonate, sodium sesquicarbonate, baking soda, hexamidine, zinc carbonate, thymol, polyvinyl formate, salycilic acid, niacinamide and combinations thereof.

The concentration of the optional other active(s) may range, individually or cumulatively, from about 0.001%, from about 0.01%, of from about 0.1%, by weight of the composition to about 20%, to about 10%, to about 5%, or to about 1%, by weight of the composition.

Propellants

Propellants are materials that are capable of creating the cellular structure or bubbles that comprise a foam. These materials expand upon release from the package, thereby creating bubbles that form the cellular structure of the foam. Any propellant capable of converting the oil in water emulsion from a liquid to a foam is suitable for use in the present invention. This includes, but is not limited to, liquified gases and compressed gasses. It is appreciated that the type, pressure, and level of the propellant should not result in aresolization of the product such that the product becomes airborne during the dosing process. Further it is appreciated that the choice of type, pressure, and amount of the propellant will be related to the type of valve used to release the foaming antiperspirant or deodorant product, the flow path to the application surface, and the size of the container that holds the foaming antiperspirant or deodorant product prior to its release. The inventors have found that foam creation and delivery to an application surface is best achieved with propellant concentrations of at most about 15%, by weight of the composition. In some embodiments, foam creation and delivery is achieved with at most about 10% propellant, and in others it is achieved with at most about 5% propellant, by weight of the composition.

Some suitable liquidifed gas propellants may have a boiling point (at atmospheric pressure) within the range of from about −45° C. to about 5° C. Some suitable liquidifed gas propellants may include chemically-inert hydrocarbons such as propane, n-butane, isobutane and cyclopropane, and mixtures thereof, as well as halogenated hydrocarbons such as dichlorodifluoromethane (propellant 12) 1,1-dichloro-1,1,2,2-tetrafluoroethane (propellant 114), 1-chloro-1,1-difluoro-2,2-trifluoroethane (propellant 115), 1-chloro-1,1-difluoroethylene (propellant 142B), 1,1-difluoroethane (propellant 152A), dimethyl ether and monochlorodifluoromethane, and mixtures thereof. Some commercially available liquidifed gas propellants suitable for use include, but are not limited to, A-46 (a mixture of isobutane, butane and propane), A-31 (isobutane), A-17 (n-butane), A-108 (propane), AP70 (a mixture of propane, isobutane and n-butane), AP40 (a mixture of propane, isobutene and n-butane), AP30 (a mixture of propane, isobutane and n-butane), Br-46 (a mixture of butane, propane and isobutane), HFO1234 (trans-1,3,3,3-tetrafluoropropene) and 152A (1,1 difluoroethane).

Suitable compressed gas propellants include but are not limited to such as nitrogen, air and carbon dioxide, nitrous oxide, argon, helium, and oxygen.

In some embodiments, water soluble propellants such as, but not limited to, dimethyl ether, carbon dioxide or nitrous oxide, and combinations thereof, will be employed. Water soluble propellants may reduce the mixing required to incorporate the propellants into the oil in water emulsion. In some other embodiments, a water insoluble propellant such as, but not limited to, A46, A31, or nitrogen may be employed to provide a desired foam appearance. However, it is appreciated that incorporation of a water insoluble propellant into the dispersed oil phase can require substantial mixing and the unincorporated material will remain segregated from the oil in water emulsion. One of the challenges in the use of propellants in the foaming antiperspirants and deodorants of the current invention is the uniformity of foam density and appearance throughout the life of the can. For example, a composition with a liquid gas propellant will maintain the pressure in the can during its use by converting liquid propellant to gaseous propellant in the head space above the oil in water emulsion in the sealed container. This process reduces the amount of liquid propellant in the oil in water emulsion that provides the foaming benefit, often resulting in a runnier foam when more than 75% of the initial product has been dispensed. Moreover, in some embodiments, this effect can substantially reduce the dose of foam released between the first and last dose of the product. Inconsistent dosing from the first to last dose of the product can result in consumer frustration and a reduction in efficacy. Surprisingly, the present inventors have found that employing two propellants, one water soluble and one water insoluble, overcomes this challenge. The second, water insoluble propellant is able to hold the first propellant in solution so that its concentration stays high. Moreover, this combination of two propellants also provides a visually more desirable foam by creating small bubbles that create a foam with a matte finish, which looks drier and more desirable to some consumers.

In the present invention, a water-soluble propellant has a water solubility of at least 0.1 weight percent in water at 20° C. Conversely, water insoluble propellants have a water solubility of at most 0.01 weight percent in water at 20° C. Examples of the water solubility of some propellants are shown in Table 2.

TABLE 2

| Propellant | Water solubility at 20° C. (weight percent) |
|---|---|
| Butane | <0.01% |
| Isobutane | <0.01% |
| Propane | <0.01% |
| Dimethyl ether | 7% |
| 1,1 difluoroethane | 0.2% |
| Nitrogen | <0.01 |
| Helium | <0.01 |
| Carbon dioxide | 0.8% |
| Nitrous oxide | 0.12 |

One example of two propellants is a blend of dimethyl ether (water soluble) and nitrogen (water insoluble). As can be seen from FIGS. 2*a* and 2*b*, a blend of these materials creates a more desired foam appearance. FIG. 2*a* shows a dispensed foam composition comprising two propellants, dimethyl ether and nitrogen. FIG. 2*b* shows the same foam composition, other than it comprises dimethyl ether alone. The foam in FIG. 2*a* is more desirable to consumers than the foam in FIG. 2*b*, as the FIG. 2*a* foam has smaller bubbles and looks drier. Move over, when the blend is employed in a package that includes a can and a metered aerosol valve, the blend results in a more uniform dosage delivery throughout the life of can. FIG. 3 is a graph showing the percent of initial dose for two compositions that are the same other than the propellant(s), in the same type of can and metered valve. The metered valve should release the same volume out of the can with each dispense. The bottom line shows the composition comprising only DME (dimethyl ether) as a propellant, while the top line shows a propellant of DME and nitrogen. As can be seen from the graph, the composition comprising the two propellants of DME and nitrogen maintains a more stable amount of the composition dispensed for each dose throughout the life of the can. That is, each successive dose is relatively close to 100% as compared to successive doses from the can with the single propellant. This means the two propellants provide a more consistent amount of composition dispensed for each dose. This results in a more consistent dosage and experience of the composition by the consumer throughout the life of the can. The composition comprising only DME over time releases less volume of composition with each dispense, because the pressure provided by the single propellant becomes too low to release a full dose.

Test Method for Oil Phase Emollient Solubility

To test for solubility of the second oil phase emollients in the first oil phase emollients at a 5% level, or said differently, to test that the second oil phase emollients have less than or at most 5% solubility in the first oil phase emollients, add 19 grams of the first oil phase emollients and 1 gram of the second oil phase emollients to an 8-dram vial. Vigorously shake the vial for approximately 30 seconds to allow mixing and then allowing the vial to set unmoved for 5 minutes. After 5 minutes, a single-phase clear solution indicates too much solubility and a test failure, meaning there is a higher solubility than 5% of the second oil phase emollients in the first oil phase emollients. The formation of something other than a single-phase solution indicates a test passing result, meaning that there is at most a 5% solubility of the second oil phase emollients in the first oil phase emollients. Passing observations can include, but are not limited to, the formation of two clear solutions layers, a hazy and a clear layer, two hazy layers, a single hazy layer, a single opaque layer, or any other condition that one skilled in the art would deem to not be a single phase clear solution. Examples of passing and failing solutions are shown in FIG. 4. The passing solution on the left comprises a first oil phase emollient of PPG-15 stearyl ether and a second oil phase emollient of 50 cst dimethicone. The failing solutions on the right comprise a first oil phase emollient of Isopropyl myristate and a second oil phase emollient of 5 cst dimethicone. One skilled in the art will understand that testing for solubility at a lower concentrations. or that testing for various levels of solubility (e.g., 1% solubility or 0.5% solubility). can be done by appropriately adjusting the weights of the two oil phase emollients in the 8-dram vial, then mixing and evaluating the vial in the manner disclosed above.

Combinations:

A. An aerosol foam dispenser comprising:
  a. a pressurized container having side walls, a closed base at a first end, and an open neck at a second end and defining a volume therein; wherein the volume is adapted for one or more propellants and a liquid composition;
  b. a valve assembly for selectively dispensing product from said aerosol dispenser as a foam comprising:
    i. a valve stem having a hollow center with a radial axis; wherein the hollow center is disposed for flow of the composition during dispensing and;
    ii. a mounting cup joined to the neck;
  c. an actuating mechanism in operative communication with the valve assembly;
  d. a dome coupled to the valve stem; wherein the dome comprises an inner surface and a skin contacting surface having one or more exit orifices; wherein the one or more exit orifices and the radial axis of the valve stem are non-linear;
  e. a diptube comprising an end open to the liquid composition and an end coupled to the valve assembly.

B. An aerosol foam dispenser comprising:
  a. a pressurized container having side walls, a closed base at a first end, and an open neck at a second end and defining a volume therein; wherein the volume is adapted for one or more propellants and a liquid composition;
  b. a metered valve assembly for selectively dispensing product from said aerosol dispenser as a foam comprising:
    i. a valve stem having a hollow center disposed for flow of the composition during dispensing and an open end;
    ii. a mounting cup joined to the neck;
  c. an actuating mechanism in operative communication with the valve assembly;
  d. a dome distal having a skin contacting surface; wherein the dome is coupled to the valve stem and the open end of the valve stem is approximately flush with the skin contacting surface;
  e. a diptube comprising an end open to the liquid composition and an end coupled to the valve assembly.

C. An aerosol foam dispenser comprising:
  a. a pressurized container having side walls, a closed base at a first end, and an open neck at a second end and defining a volume therein; wherein the volume is adapted for one or more propellants and a liquid composition;
  b. a valve assembly for selectively dispensing product from said aerosol dispenser as a foam comprising:
    i. a valve stem having a hollow center;
    ii. a mounting cup joined to the neck;

c. an actuating mechanism in operative communication with the valve assembly;

d. a dome coupled to the valve stem; wherein the dome comprises an inner surface, a skin contacting surface having one or more exit orifices, and an umbrella valve in fluid communication with the one or more exit orifices;

e. a diptube comprising an end open to the liquid composition and an end coupled to the valve assembly.

D. The aerosol foam dispenser of paragraphs A-C, wherein the actuating mechanism is adjacent to closed base of the pressurized container.

E. The aerosol foam dispenser of paragraphs A-D, wherein the actuating mechanism is a knob.

F. The aerosol foam dispenser of paragraphs A-E, wherein the dispenser further comprises a shroud substantially surrounding the side walls and at least a portion of the base of the pressurized container and coupled to the actuating mechanism.

G. The aerosol dispenser of paragraphs A-F, wherein the shroud is reusable.

H. The aerosol dispenser of paragraphs A-G, wherein the shroud comprises contoured sidewalls.

I. The aerosol foam dispenser of paragraphs A-H, wherein the valve assembly is a metered dose valve in fluid connection with the diptube and the valve stem.

J. The aerosol foam dispenser of paragraphs A-I, wherein the dome further comprises an umbrella valve in fluid communication with the one or more exit orifices.

K. The aerosol foam dispenser of paragraphs A-J, wherein the dome further comprises non-linear channels adapted to fluidly connect the valve stem with the one or more exit orifices.

L. A method for dispensing a foam antiperspirant or deodorant composition comprising:

a. providing the aerosol foam dispenser of paragraphs A-K, wherein the liquid composition comprises an antiperspirant or deodorant composition;

b. actuating the actuating mechanism thereby raising the pressurized container and thereby depressing the valve stem against the inside surface of the dome;

c. dispensing the antiperspirant or deodorant composition as a foam.

M. The method of paragraph L, wherein the actuating mechanism is activated by turning the actuating mechanism.

N. The method of paragraphs L-M, wherein the actuating mechanism comprises a base having an inner surface and wherein two or more ramps extend from the inner surface adapted for raising the pressurized container when the actuating mechanism is activated.

O. The aerosol foam dispenser of paragraphs A-N, wherein the volume is adapted for one or more propellants comprising (a) a first propellant with at least 0.1% water solubility at 20° C.; (b) a second propellant with a water solubility of at most 0.01% at 20° C.; the liquid composition comprising an oil and water emulsion; wherein the liquid composition is an antiperspirant or deodorant composition.

P. The composition of paragraph O, wherein the second propellant is a liquified gas.

Q. The composition of paragraph O, wherein the second propellant is a compressed gas.

R. The composition of any one of paragraphs O to Q, wherein the second propellant is selected from the group consisting of nitrogen, butane, isobutene, propane, and mixtures thereof.

S. The composition of any one of paragraphs O to R, wherein the oil in water emulsion comprises two oil phases.

T. The composition of paragraph S, wherein the emulsion comprises a first oil phase comprising an organic emollient and a fragrance.

U. The composition of paragraph T, wherein the weight ratio of the organic emollient to the fragrance is at least about 1:1.

V. The composition of paragraph T, wherein the weight ratio of the organic emollient to the fragrance is from about 1:1 to about 10:1.

W. The composition of paragraph T, wherein the weight ratio of the organic emollient to the fragrance is from about 3:1 to about 7:1.

X. The composition of paragraph S, wherein the oil in water emulsion comprises a second oil phase comprising dimethicone, wherein the dimethicone in the second oil phase has at most 5% solubility in the organic emollient in the first oil phase.

Y. The composition of any one of paragraphs O to X, wherein the oil in water emulsion comprises two or more ethoxylated surfactants.

Z. The composition of any one of paragraphs O to Y, wherein the first propellant is carbon dioxide, dimethyl ether, or mixtures thereof.

AA. The composition of any one of paragraphs O to Z, wherein the composition is contained in a device, wherein the device comprises a metered valve.

BB. The composition of any one of paragraphs O to AA, wherein the oil in water emulsion further comprises an antiperspirant or deodorant active.

CC. The composition of paragraph BB, wherein the antiperspirant active is aluminum dichlorohydrate or aluminum sesquichlorohydrate.

DD. The composition of any one of paragraphs O to CC, wherein the emulsion does not comprise a fatty alcohol.

EE. The composition of any one of paragraphs O to EE, wherein the composition comprises at most about 15% total propellant, by weight of the composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aerosol foam dispenser comprising:

a. a pressurized container having side walls, a closed base at a first end, and an open neck at a second end and defining a volume therein; wherein the volume is adapted for one or more propellants and a liquid composition;

b. a valve assembly for selectively dispensing product from said aerosol dispenser as a foam comprising:

i. a valve stem having a hollow center with a radial axis; wherein the hollow center is disposed for flow of the composition during dispensing and;

ii. a mounting cup joined to the neck;

c. an actuating mechanism in operative communication with the valve assembly, the actuating mechanism is adjacent to the closed base of the pressurized container, the actuating mechanism is activated by turning the actuating mechanism, and the actuating mechanism comprising a knob;

d. a dome coupled to the valve stem; wherein the dome comprises an inner surface and a skin contacting surface having one or more exit orifices; wherein the one or more exit orifices and the radial axis of the valve stem are non-linear;

e. a diptube comprising an end open to the liquid composition and an end coupled to the valve assembly;

f. a shroud substantially surrounding the side walls and at least a portion of the base of the pressurized container and coupled to the actuating mechanism.

2. The aerosol dispenser of claim 1, wherein the shroud is reusable.

3. The aerosol dispenser of claim 1, wherein the shroud comprises contoured sidewalls.

4. The aerosol foam dispenser of claim 1, wherein the valve assembly is a metered dose valve in fluid connection with the diptube and the valve stem.

5. The aerosol foam dispenser of claim 1, wherein the dome further comprises an umbrella valve in fluid communication with the one or more exit orifices.

6. The aerosol foam dispenser of claim 1, wherein the dome further comprises non-linear channels adapted to fluidly connect the valve stem with the one or more exit orifices.

7. The aerosol foam dispenser of claim 1, the volume is adapted for one or more propellants comprising (a) a first propellant with at least 0.1% water solubility at 20° C.; (b) a second propellant with a water solubility of at most 0.01% at 20° C.; the liquid composition comprising an oil and water emulsion; wherein the liquid composition is an antiperspirant or deodorant composition.

8. The aerosol foam dispenser of claim 7, wherein the oil and water emulsion further comprises an antiperspirant active; wherein the first propellant is carbon dioxide, dimethyl ether, or mixtures thereof; wherein the second propellant is selected from nitrogen, butane, isobutene, propane, and combinations thereof.

9. A method for dispensing a foam antiperspirant or deodorant composition comprising:

a. providing the aerosol foam dispenser of claim 1, wherein the liquid composition comprises an antiperspirant or deodorant composition;

b. actuating the actuating mechanism thereby raising the pressurized container and thereby depressing the valve stem against the inside surface of the dome;

c. dispensing the antiperspirant or deodorant composition as a foam.

10. The method of claim 9, wherein the actuating mechanism comprises a base having an inner surface and wherein two or more ramps extend from the inner surface adapted for raising the pressurized container when the actuating mechanism is activated.

* * * * *